US008083867B2

(12) United States Patent
Yoshizawa et al.

(10) Patent No.: US 8,083,867 B2
(45) **Date of Patent: *Dec. 27, 2011**

(54) AMORPHOUS ALLOY RIBBON, NANOCRYSTALLINE SOFT MAGNETIC ALLOY AND MAGNETIC CORE CONSISTING OF NANOCRYSTALLINE SOFT MAGNETIC ALLOY

(75) Inventors: Yoshihito Yoshizawa, Saitama (JP); Yuichi Ogawa, Saitama (JP)

(73) Assignee: Hitachi Metals, Ltd., Tokyo (JP)

( * ) Notice: Subject to any disclaimer, the term of this patent is extended or adjusted under 35 U.S.C. 154(b) by 547 days.

This patent is subject to a terminal disclaimer.

(21) Appl. No.: 12/087,318

(22) PCT Filed: Sep. 21, 2006

(86) PCT No.: PCT/JP2006/318733

§ 371 (c)(1),
(2), (4) Date: Oct. 10, 2008

(87) PCT Pub. No.: WO2007/077651

PCT Pub. Date: Jul. 12, 2007

(65) Prior Publication Data

US 2009/0065100 A1 Mar. 12, 2009

(30) Foreign Application Priority Data

Jan. 4, 2006 (JP) ..... 2006-000086

(51) Int. Cl.
*C22C 45/02* (2006.01)

(52) U.S. Cl. ..... 148/304; 148/403; 420/82; 420/89

(58) Field of Classification Search ..... 148/304, 148/403

See application file for complete search history.

(56) References Cited

U.S. PATENT DOCUMENTS

| | | | | |
|---|---|---|---|---|
| 4,881,989 | A * | 11/1989 | Yoshizawa et al. | 148/302 |
| 7,425,239 | B2 * | 9/2008 | Ogawa et al. | 148/304 |
| 2006/0000524 | A1 * | 1/2006 | Ogawa et al. | 148/304 |

FOREIGN PATENT DOCUMENTS

| | | | |
|---|---|---|---|
| CN | 1092201 | A | 9/1994 |
| CN | 1689733 | A | 11/2005 |
| JP | 64-079342 | | 3/1989 |
| JP | 01-242755 | | 9/1989 |
| JP | 2000-328206 | | 11/2000 |
| JP | 2001-295005 | | 10/2001 |
| JP | 2001-296005 | | 10/2001 |
| JP | 2001-300697 | | 10/2001 |
| JP | 2006-45662 | | 2/2006 |

* cited by examiner

*Primary Examiner* — George Wyszomierski

(74) *Attorney, Agent, or Firm* — Paul F. Neils, Esq.; Edwards Neils PLLC

(57) ABSTRACT

Even if produced from a broad amorphous alloy ribbon, a nano crystal soft magnetic alloy, a magnetic core made of a nano crystal soft magnetic alloy, and the amorphous alloy ribbon for a nano crystal soft magnetic alloys which has the excellent alternate magnetic property, the small dispersion, the excellent temporal stability in high temperature, the excellent mass productivity can be provided.

An amorphous alloy ribbon, wherein the alloy composition is represented by $Fe_{100-a-b-c-d}M_aSi_bB_cC_d$ (atomic %), $0<a\leqq10$, $0\leqq b\leqq20$, $2\leqq c\leqq20$, $0<d\leqq2$, $9\leqq a+b+c+d\leqq35$, and an amorphous alloy ribbon consists of inevitable impurities, and said M is at least one element selected from Ti, V, Zr, Nb, Mo, Hf, Ta, and W, and C concentration takes maximum value at 2-20 nm depth from the surface of said amorphous alloy with equivalent $SiO_2$.

12 Claims, 2 Drawing Sheets

[Figure 1]

AMORPHOUS ALLOY RIBBON, NANOCRYSTALLINE SOFT MAGNETIC ALLOY AND MAGNETIC CORE CONSISTING OF NANOCRYSTALLINE SOFT MAGNETIC ALLOY

CROSS-REFERENCE TO RELATED APPLICATIONS

The present application is a 35 U.S.C. 371 national stage entry of PCT/JP2006/318733, filed Sep. 21, 2006, and claims priority from Japanese Patent Application No. 2006-000086, filed Jan. 4, 2006, the contents of which are herein incorporated by reference in their entirety.

BACKGROUND OF THE INVENTION

1. Field of the Invention

This invention relates to an amorphous alloy ribbon for a nanocrystalline soft magnetic alloy, a nanocrystalline soft magnetic alloy made from an amorphous soft magnetic alloy ribbon, and a magnetic core made from a nanocrystalline soft magnetic alloy which is used for various transformers and various reactor choke coils, a noise suppression component, a pulse power magnetic component used for a laser power supply, an accelerator, or the like, a pulse transformer for communication, various motor magnetic cores, various dynamos, various magnetic sensors, an antenna magnetic core, various current sensors, a magnetic shield, or the like.

2. Description of the Related Art

As a soft magnetic material used for various transformers, various reactors, a choke coil, a noise suppression component, a laser power supply, a pulse power magnetic component for accelerators, or the like, a silicon steel, a ferrite, an amorphous alloy, a nanocrystalline alloy, or the like is known. Since a ferrite material has a problem that the saturation flux density is low and the temperature characteristic is bad, a ferrite is magnetically saturated easily and unsuitable for the use of high power designed to become the magnetic flux density of operation large. A silicon steel plate is a cheap material with a high magnetic flux density, but it has a problem that the magnetic core loss is large for the use of high frequency. An amorphous alloy is ordinarily produced from a liquid phase or a vapor phase by rapidly cooling. It is known that an amorphous alloy of Fe group or Co group does not have the magnetocrystalline anisotropy essentially and has an excellent soft magnetic characteristics since a crystal grain is not present, and is used for a transformer iron core for electric power, a choke coil, a magnetic head, a current sensor, or the like. There is a problem that an amorphous alloy of Fe group has the large magnetostriction, however, it does not obtain the high magnetic permeability compared to an amorphous alloy of Co group. There is also a problem that an amorphous alloy of Co group has the low magnetostriction and high magnetic permeability, however, it has the low saturation flux density which is less than or equal to 1 T (Tesla).

It is known that an nanocrystalline alloy shows the excellent soft magnetic characteristic which is equivalent to an amorphous alloy of Co group and the high saturation flux density which is equivalent to an amorphous alloy of Fe group, and is used for a noise suppression component such as a common mode choke coil or the like, a high frequency transformer, a pulse transformer, a magnetic core such as a current sensor or the like. A typical composition system is a Fe—Cu—(Nb, Ti, Zr, Hf, Mo, W, Ta)—Si—B system alloy, a Fe—Cu—(Nb, Ti, Zr, Hf, Mo, W, Ta)—B system alloy, or the like described in Patent document 1 and Patent document 2 are known. These nanocrystalline alloys of Fe group are ordinarily produced an amorphous alloy from a liquid phase or a vapor phase by rapidly cooling and then microcrystallized by heat treatment. It is known that a method of rapidly cooling from a liquid phase is a single roll method, a twin roll method, a centrifugal rapidly cooling method, an in-rotating liquid spinning method, an atomizing method, a cavitation method, or the like. It is known that a method of rapidly cooling from a vapor phase is a sputtering method, an evaporation method, an ion plating method, or the like. It is known that a nanocrystalline alloy of Fe group is microcrystallized an amorphous alloy produced by these methods, and does not almost have the thermal instability which is observed by an amorphous alloy, and shows an excellent soft magnetic characteristic which is the high saturation flux density and the low magnetostriction comparable as Fe system amorphous alloy. It is known that a nanocrystalline alloy has a small change in characteristics with time and also has excellent temperature characteristics.

Patent document 1: Japanese Patent Publication No. H04-004393 (Page 5, column 10, lines 31-43).

Patent document 2: Japanese Patent Laid Open Publication No. H01-242755 (Page 3, left upper column, line 15-right upper column, line 5).

SUMMARY OF THE INVENTION

Problems to be Solved by the Invention

When an amorphous alloy ribbon is mass-produced, it is generally produced by melting and rapidly cooling method such as the single roll method. A nano crystal soft magnetic alloy is produced by heat treatment and crystallization of this amorphous alloy ribbon. However, when a nano crystal soft magnetic alloy is mass-produced, in order to improve the mass productivity and to reduce the material cost, a nano crystal soft magnetic alloy is produced by firstly preparing a broad amorphous alloy ribbon, processing by slitting, cutting, punching, or the like if necessary, and then performing heat treatment for the processed amorphous alloy ribbon. Therefore, there are problems that the magnetic property of the mass-produced nano crystal soft magnetic alloy is influenced in the quality of the broad amorphous alloy ribbon, and the soft magnetic property of the nano crystal soft magnetic alloy produced from the broad amorphous alloy ribbon can easily vary the alternate magnetic property or change the characteristics compared to the nano crystal soft magnetic alloy produced from the amorphous alloy ribbon produced by the compact apparatus at a laboratory level. As this cause, it is considered that the remaining stress of the broad amorphous alloy ribbon surface at a mass production level, the difference in a surface layer, or the like is also influenced in the alternate magnetic property of the nano crystal soft magnetic alloy after heat treatment. Especially in the case of mass production, in order to reduce the material price, an iron source containing C, which is cheaper, is used. Therefore, this C is supposed to segregate to the ribbon surface at the time of production of the amorphous alloy ribbon, and to become the cause of the dispersion of the alternate magnetic property and the changes in characteristics with time of the heat treated nano crystal soft magnetic alloy.

As described above, even if a broad amorphous alloy ribbon is used, an appearance of the amorphous alloy ribbon for a nanocrystalline alloy and a nano crystal soft magnetic alloy which has the favorable soft magnetic characteristics, the small dispersion in the alternate magnetic property, the temporal stability, and the mass productivity, and a magnetic core made of a nano crystal soft magnetic alloy which has the favorable alternate characteristic and the small characteristic dispersion is desired strongly.

As mentioned above, in the nano crystal soft magnetic alloy produced from the broad amorphous alloy ribbon containing C and the magnetic core produced from the nano crystal soft magnetic alloy, it is difficult to realize the nano crystal soft magnetic alloy which has the small dispersion in alternate magnetic property and the excellent temporal stability in high temperature, and the magnetic core made of a nano crystal soft magnetic alloy previously.

Therefore, the object of the present invention is to regulate the position and the maximum value of C segregation layer on the ribbon surface by controlling the C amount of the amorphous alloy ribbon composition for the nano crystal soft magnetic alloys, the roll face surface roughness, the gas atmosphere around the nozzle tip part for the production of amorphous alloy ribbon, and to provide the nano crystal soft magnetic alloy, the magnetic core made of the nano crystal soft magnetic alloy, and the amorphous alloy ribbon for the nano crystal soft magnetic alloy which has the excellent alternate magnetic property even if produced from a broad amorphous alloy ribbon, the small dispersion, the favorable temporal stability in high temperature, and the excellent mass productivity.

Means for Solving the Problem

In the present invention, C segregation on the surface of alloy is regulated by controlling the C amount of the amorphous alloy ribbon composition, and controlling the gas atmosphere around the cooling roller of the nozzle tip part in the case of the ribbon production, and the nano crystal soft magnetic alloy, the magnetic core made of the nano crystal soft magnetic alloy, and the amorphous alloy ribbon for the nano crystal soft magnetic alloy which has the excellent alternate magnetic property even if produced from a broad amorphous alloy ribbon, the small dispersion, the favorable temporal stability in high temperature, and the excellent mass productivity is realized.

In the aspect of the present invention, an amorphous alloy ribbon, wherein the alloy composition is represented by $Fe_{100-a-b-c-d}M_aSi_bB_cC_d$ (atomic %), $0<a\leqq 10$, $0\leqq b\leqq 20$, $2\leqq c\leqq 20$, $0<d\leqq 2$, $9\leqq a+b+c+d\leqq 35$, and an amorphous alloy ribbon consists of inevitable impurities, said M is at least one element selected from Ti, V, Zr, Nb, Mo, Hf, Ta, and W, and C concentration takes maximum value at 2-20 nm depth from the surface of said amorphous alloy with equivalent $SiO_2$. Thus, by controlling the C amount on the surface of the amorphous alloy ribbon, in the nanocrystalline alloy produced by crystallization with heat treatment to the narrow amorphous alloy ribbon which is the broad amorphous alloy ribbon itself or the slit of broad amorphous alloy ribbon, the excellent alternate magnetic property is obtained, characteristic dispersion is also reduced, and the temporal stability of the magnetic property in high temperature is also superior. Here, the maximum of C concentration indicates by the production which has a concentration gradient in the thickness direction of the ribbon, and it is not including the contamination gathering on the surface of the amorphous alloy ribbon.

Here, M is at least one element selected from Ti, V, Zr, Nb, Mo, Hf, Ta, and W, and has an effect that a crystal grain produced after crystallization is miniaturize and the amorphousization is assisted in the case of amorphous alloy production. B is an element which has an effect of the amorphousization and the crystal grain miniaturization after heat treatment of crystallization, and it is not preferable that the amount c of B is less than 2% since the amorphousization is difficult and the crystal grain becomes large, and it is not also preferable that the amount c of B is more than 20% since a Fe—B compound is easy to form by the crystallization with heat treatment and the alternate magnetic property is deteriorated. Si is an element which has an effect of assisting the amorphousization and dissolving to the crystal grain formed by crystallization and then reducing magnetocrystalline anisotropy and magnetostriction, and it is not preferable that the amount b of Si is more than 20% since an amorphous alloy ribbon is embrittled in the case that the amorphous alloy ribbon production and the subsequent processing becomes difficult. C has an effect of lowering the viscosity of alloy melting in the case of amorphous alloy ribbon production and improving the surface appearance of an amorphous alloy, meanwhile there is a problem that the temporal stability is degraded and the dispersion in alternate magnetic property becomes large. On the other hand, in producing an amorphous alloy ribbon of the present invention, the amorphous alloy ribbon surface can be segregated by controlling a gas atmosphere around the roll surface of nozzle tip part. Thereby, even if using a broad amorphous alloy ribbon which has an excellent mass productivity, the nanocrystalline alloy which has the favorable alternate magnetic property, the small dispersion, the excellent temporal stability in high temperature, and the mass productivity can be realized.

As a method of controlling the gas atmosphere around the roll surface of a nozzle tip part, there are a method of spraying $CO_2$ gas on a roll, a method of burning CO gas or the like and generating $CO_2$ gas, and then increasing $CO_2$ gas concentration around the roll surface of a nozzle tip part, a method of inserting a single roll production equipment in a chamber and introducing $CO_2$ gas into a chamber, or the like. Especially, it is preferable that the $CO_2$ gas concentration is more than 5%. It is not preferable that the amount d of C is more than 2% since the amorphous alloy ribbon embrittled easily and the temporal stability in high temperature is also deteriorated. Especially, it is preferable that the scope of the amount d of C is $0.01\leqq d\leqq 0.8$. Total amount a+b+c+d of M element, Si, B, and C needs to be $9\leqq a+b+c+d\leqq 35$. It is not preferable that the amount a+b+c+d is less than 9% since the amorphousization is difficult and the amount is more than 35% since the amorphous alloy ribbon is embrittled easily and the saturation flux density is also reduced too much.

In the case that less than or equal to 3 atomic % of Fe is substituted by at least one element selected from Cu and Au, a preferable result is obtained since the soft magnetism of the nano crystal soft magnetic alloy is further improved and the high magnetic permeability and the low magnetic core loss can be realized. Especially, it is preferable that the amount of substitution of at least one element selected from Cu and Au is 0.5-2% to the amount of Fe and the high magnetic permeability is especially obtained in the scope.

Also, in the case that the amount b of Si is $8\leqq b\leqq 17$ and the amount c of B is $5\leqq c\leqq 10$, the high magnetic permeability is especially obtained in this nanocrystalline alloy. Especially, in the case that the amount b of Si is $14\leqq b\leqq 17$, it is more preferable that the magnetostriction of the nano crystal soft magnetic alloy becomes small.

A part of Fe may be substituted by at least one element selected from Co and Ni. It is possible to control the size of the induced magnetic anisotropy by substituting to Co and Ni, the B-H loop with high squareness ratio or the B-H loop with more sufficient linearity can be obtained, and the more preferable characteristics for the magnetic core for saturable reactors, the magnetic core for current sensors, or the like can be realized.

Less than or equal to 50% of total amount of Si and B may be substituted by at least one element selected from Al, P, Ga, Ge, and Be. It is possible to control the electric resistivity, the magnetostriction, or the like by substituting these elements.

Less than or equal to 50% of M may be substituted by at least one element selected from Cr, Mn, Zn, As, Se, S, O, N, Sb, Sn, In, Cd, Ag, Bi, Mg, Sc, Re, platinoid elements, Y, and rare earth elements. It is possible to improve the corrosion resistance or to regulate the electric resistivity and the magnetic property by substituting these elements. Here, the platinoid elements are Ru, Rh, Pd, Os, Ir, and Pt, and the rare earth elements are La, Ce, Pr, Nd, Pm, Sm, Eu, Gd, Th, Dy, Ho, Er, Tm, Yb, and Lu.

Another present invention is that a nanocrystalline soft magnetic alloy which is formed by heat treatment of the amorphous alloy ribbon, wherein at least a part of structure is consisted of a crystal grain with a mean particle size of less than or equal to 50 nm and C concentration takes maximum value at 2-20 nm depth from the surface of said alloy with equivalent $SiO_2$. The amorphous alloy ribbon of above mentioned present invention which regulated by C segregation on the surface is used as a base material, and the nano crystal soft magnetic alloy of the present invention produced by heat treatment and nano crystallization has the excellent alternate magnetic property, the small dispersion, the excellent temporal stability in high temperature, and the excellent mass productivity. The crystalline phase of the nano crystal soft magnetic alloy of the present invention may dissolve Si, B, Al, Ge, Zr, or the like and may include ordered lattices such as $Fe_3Si$.

Especially, in the case that the mean particle size of a crystal grain is less than or equal to 20 nm, the volume fraction of the crystal is more than 50%, the crystal is a body centered cubic crystal, and the remainder is amorphous phase, it is preferable that the high magnetic permeability and the low magnetic core loss is especially obtained in this nano crystal soft magnetic alloy.

This nano crystal soft magnetic alloy is produced by rapidly cooling the melting of above mentioned composition with rapidly cooling method such as the single roll method, once producing the above mentioned amorphous alloy ribbon, then processing this and increasing in temperature more than crystallization temperature, and forming a microcrystal with a mean particle size of less than or equal to 50 nm. While it is preferable that the amorphous alloy ribbon before heat treatment does not include a crystalline phase, it may also include a crystalline phase in part. In the case of not including active metal, the rapidly cooling method such as a single roll method is possible to perform in the atmosphere, however, in the case of including active metal, it is performed in the inert gas, such as Ar, He, or the like, or under decompression. In order to control the gas atmosphere around the roll surface of a nozzle tip part and to control the surface segregation of C, the production is performed by the method of spraying $CO_2$ gas on a roll, the method of burning CO gas or the like, generating $CO_2$ gas and increasing $CO_2$ gas concentration around the roll surface of a nozzle tip part, the method of introducing $CO_2$ gas into a chamber, the method of producing in the atmosphere containing $CO_2$ gas, or the like.

The heat treatment is usually performed in an inert gas such as argon, nitrogen, helium, or the like. To the nano crystal soft magnetic alloy of the present invention, induced magnetic anisotropy can be given by performing heat treatment in the magnetic field. The heat treatment in the magnetic field is performed to impress the sufficient strength to be saturated the alloy for at least a part of time of the heat treatment. Although it is also dependent on the shape of alloy magnetic core, generally the magnetic field which is greater than 8 $kAm^{-1}$ is impressed in the across-the-width direction of the ribbon (it is the height direction of the magnetic core in the case of tape wound core). The magnetic field to impress can be used any of direct current, alternate current, and repetitive pulsed magnetic field. The magnetic field is generally impressed for more than 20 minutes in the temperature range of more than 200° C. Since one axis of induced magnetic anisotropy is given accurately by being impressed in the case during heating, maintaining constantly, and cooling in temperature, more preferable direct current or alternate current hysteresis loop shape is realized. The alloy having the direct current hysteresis loop with a high squareness ratio or a low squareness ratio can be obtained by application of heat treatment in the magnetic field. In the case of not applying the heat treatment in the magnetic field, the alloy of the present invention has a direct current hysteresis loop with a degree of middle squareness ratio. It is preferable that the heat treatment is generally performed in the inert gas atmosphere with the dew point of less than or equal to −30° C., and it is more preferable that the heat treatment is generally performed in the inert gas atmosphere with the dew point of less than or equal to −60° C. since dispersion becomes further smaller and a more preferable result is obtained. The highest achieving temperature in the case of heat treatment is more than the crystallization temperature, and the scope is generally within 400 to 700° C. In the case of the heat treatment pattern maintaining at a constant temperature, the retention time at a constant temperature is generally less than or equal to 24 hours, and preferably less than or equal to 4 hours. In the case of heat treatment, the average heating temperature rate is preferably from 0.1° C./min to 200° C./min and more preferably from 0.1° C./min to 100° C./min, the average cooling temperature rate is preferably from 0.1° C./min to 300° C./min and more preferably from 0.1° C./min to 100° C./min, and the alloy with low magnetic core loss is especially obtained within the scopes. The heat treatment does not need to be one step, the many steps of the heat treatment or several times of the heat treatment can also be performed. Also, the heat treatment can be performed by generating heat in the alloy with applying the direct current, the alternate current, or the pulsed current. In the case of heat treatment, the heat treatment is performed with applying tension and compressive force, and then the magnetic property can be improved. In the case of the heat treatment with impressing the tension, the nanocrystalline alloy and the magnetic core having the inclined hysteresis curve whose relative permeability is 100-about several 1000 with a low squareness ratio can be realized.

To the nano crystal soft magnetic alloy of the present invention, more preferable result can be obtained by the treatment such as coating the alloy ribbon surface with the powder or the film made of such as $SiO_2$, MgO, $Al_2O_3$, forming the insulating layer by a surface treatment with chemical conversion treatment, performing the inter-level isolation by forming an oxide insulating layer ion the surface by anodic oxidation treatment if necessary since the high frequency characteristic is further improved. When the magnetic core is especially produced, it has an effect of reducing the influence of the eddy current in a high frequency between layers, and improving the magnetic core loss in a high frequency. This effect is especially prominent in the case of using the magnetic core with a favorable surface appearance and a broad ribbon. Although the amorphous alloy ribbon of the present invention is for a nanocrystal soft magnetic alloys, the alloy which maintained the amorphous state by the heat treatment in the heat treatment condition of non-crystallization can also be used as a magnetic core material depending on use.

Another present invention is that a magnetic core comprising the nanocrystal soft magnetic alloy. The tape wound core and a lamination magnetic core which consists of a nano crystal soft magnetic alloy of the present invention show the excellent characteristic. It is also possible to perform impregnation, coating, or the like to the magnetic core of the present invention, if necessary. It can be produced by impregnating with resin such as an epoxy resin, an acrylic resin, a polyimide resin, or the like, or bonding with an alloy. A magnetic core is inserted into a resin case or the like, or generally used with coating. It may also be cut and formed a cut core. The sheet shaped object by mixing the powder magnetic core which is hardened the powders and flakes ground the above mentioned alloy with water glass, resin, or the like, powders and flakes made from the above mentioned alloy with a resin or the like is included in the present invention.

EFFECT OF THE INVENTION

In the present invention, the effect is prominent even if used cheap materials which include C since a nano crystal soft magnetic alloy, a magnetic core made of a nano crystal soft magnetic alloy, and an amorphous alloy ribbon for a nano crystal soft magnetic alloy which has the excellent alternate magnetic property, the small dispersion, the excellent temporal stability in high temperature, the excellent mass productivity can be provided.

DESCRIPTION OF THE PREFERRED EMBODIMENTS

Hereafter, the present invention is explained according to embodiments, but the present invention is not limited to these.

Embodiment 1

As an example of the present invention, the amorphous alloy ribbon was produced by injecting the alloy melting heated at 1300° C. of the alloy composition $Fe_{bal.}Cu_{0.9}Mo_3Si_{15.5}B_{7.5}C_{0.1}$ (atomic %) on the water cooled Cu—Cr alloy roll with an outer diameter of 400 mm rotating on the circumferential speed 30 m/s. By casting with spraying $CO_2$ gas heated at 100° C. from a gas nozzle on Cu alloy roll from the position of about 20 mm back from the slit position of the nozzle injecting the melting, C segregation layer was formed in 2-20 nm from the surface. $CO_2$ gas concentration around the roll surface of the nozzle tip part was 35%. The produced amorphous alloy ribbon is 50 mm in width and 20 μm in thickness. FIG. 2 is a pattern section figure of this production apparatus. In amorphous alloy ribbon production apparatus 1, alloy melting 4 heated to the aforementioned temperature in nozzle 3 with the high frequency dielectric heating by high frequency coil 2 passes through slit 5 and then injects on the surface of rotating cooling roller 6. Here, $CO_2$ gas 8 is sprayed from gas nozzle 7 which is in the position about 20 mm behind to the rolling direction of slit 5, and amorphous alloy ribbon 9 is formed on the surface of cooling roller 6. Here, CO gas may be used instead of $CO_2$ gas 8. Surface depth direction element concentration analysis from the roll face (surface in contact with a roll) of the produced amorphous alloy ribbon 9 was conducted in GD-OES (glow discharge luminescence surface analysis apparatus). An example of the test result is shown in FIG. 1. C concentration maximum position was set as the highest part of the C concentration except for the outermost surface part. C concentration maximum position was defined as a distance from the alloy ribbon surface estimated with equivalent $SiO_2$. As a comparative example, the amorphous alloy ribbon with the similar alloy composition was produced in the atmosphere which $CO_2$ gas concentration is less than 0.1% around the roll surface of a nozzle tip part. Then, the produced amorphous alloy ribbon was slit to 10 mm in width. The tape wound core was produced by winding the slit alloy ribbon with an outer diameter of 35 mm and an inner diameter of 25 mm. This tape wound core was inserted in the furnace with nitrogen gas atmosphere, and it is heated with the heating temperature rate of 7.5° C./min from room temperature to 450° C., then maintained for 20 min at 450° C., then heated with the heating temperature rate of 1.3° C./min to 530° C., then maintained for 1 hour at 530° C., then cooled with the cooling temperature rate of 1.2° C./min to 200° C., and then took out from the furnace and cooled to room temperature. The magnetic property of the sample after heat treatment were measured. C concentration of the surface depth direction was analyzed by the X-ray diffraction, the transmission electron microscopic observation, and GD-OES of the alloy with heat treatment. The average crystal grain diameter D was estimated from the crystal maximum half power band width of the X-ray diffraction. As a result of observing a microstructure by the transmission electron microscope, both samples were confirmed that the minute crystal grain with a particle diameter of about 12 nm was contained more than 70% of tissue. Table 1 shows that the alternate relative magnetic permeability $\mu_{1k}$ at 1 kHz of the alloy after the heat treatment, the magnetic core loss $P_{cv}$ at 100 kHz and 0.2 T, the relative magnetic permeability $\mu_{1k}^{190}$ which measured again after maintaining at 150° C. for 190 hours, the average crystal grain diameter D of the alloy, and the C concentration maximum position of the alloy ribbon of the present invention example and the comparative example. In the alloy ribbon of the present invention example, C concentration takes maximum at the position of 6.3 nm from the roll face surface, $\mu_{1k}$ is higher than the alloy without the C concentration maximum produced as the comparative example, the decrease of $\mu_k^{190}$ after maintaining 150° C. for 190 hours is low and the changes in characteristics with time is small. Since $P_{cv}$ is also low, it can be used for the high frequency transformer or the magnetic core for choke coils.

TABLE 1

| No. | | Alternate relative magnetic permeability $\mu_{1k}$ [1 kHz] | Magnetic core loss $P_{cv}$ (kW m$^{-3}$) | After maintaining at 150° C. for 190 hours $\mu_{1k}(\mu_{1k}^{190})$ | Average crystal grain diameter D (nm) | C concentration maximum position |
|---|---|---|---|---|---|---|
| 1 | Present invention example | 100200 | 300 | 100100 | 12 | 6.3 nm |
| 2 | Comparative example | 79000 | 320 | 69100 | 12 | — |

Embodiment 2

As the example of the present invention examples (No. 1-33), and the comparative examples (No. 34-36), the alloy melting heated at 1300° C. of each composition shown in Table 2 was injected on the water cooled Cu—Be alloy roll with an outer diameter of 400 mm rotating at a circumferential speed 32 m/s, and the amorphous alloy ribbon was produced. By burning CO gas and casting with the flame on Cu alloy roll of about 30 mm behind from the slit position of the nozzle injecting the melting, C segregation layer was formed in 2-20 nm from the surface. $CO_2$ gas concentration around the roll surface of the nozzle tip part was 42%. The produced alloy ribbon is 70 mm in width and 18 μm in thickness. As a result of the X-ray diffraction, it was confirmed that an alloy ribbon was in an amorphous state. Surface depth direction element concentration analysis from the roll face (surface in contact with a roll) of the produced sample was conducted in GD-OES (glow discharge luminescence surface analysis device). C concentration maximum position before the heat treatment is shown in Table 2. Then, the produced amorphous alloy ribbon was slit to 10 mm in width. The tape wound core was produced by winding the slit alloy ribbon with an outer diameter of 35 mm and an inner diameter of 25 mm. This tape wound core was inserted in the furnace with nitrogen gas atmosphere, and it is heated with the heating temperature rate of 8.5° C./min from room temperature to 450° C., then maintained for 30 min at 450° C., then heated with the heating temperature rate of 1.4° C./min to 550° C., then maintained for 1 hour at 550° C., then air cooled to room temperature. The average cooling rate estimated more than 30° C./min. Then, the magnetic property of the sample (a nano crystal soft magnetic alloy) after heat treatment were measured. C concentration of the surface depth direction was analyzed by the X-ray diffraction, the transmission electron microscopic observation, and GD-OES of the nano crystal soft magnetic alloy. The average crystal grain diameter D was estimated from the crystal maximum half power bandwidth in the X diffraction. The microstructure was observed with the transmission electron microscope. As these results, every samples were confirmed that the minute crystal grain with a particle diameter of less than or equal to 50 nm was contained more than 50% of tissue. Table 2 shows that the alternate relative magnetic permeability $\mu_{1k}$ at 1 kHz of the alloy, the magnetic core loss $P_{cv}$ at 100 kHz and 0.2 T, the relative magnetic permeability $\mu_{1k}^{190}$ which measured again after maintaining at 150° C. for 190 hours, the average crystal grain diameter D of the alloy, and the C concentration maximum position before and after the heat treatment. In the amorphous alloy ribbon and the nano crystal soft magnetic alloy after the heat treatment, C concentration takes maximum at the scope of 2-20 nm depth from the surface of said alloy with equivalent $SiO_2$, the nano crystal soft magnetic alloy of the present invention shows high magnetic permeability and low magnetic core loss and the alternate magnetic property is superior and $\mu_{1k}^{190}$ after maintaining 150° C. for 190 hours is high and the changes in characteristics with time is excellent. In the amorphous alloy ribbon and the nano crystal soft magnetic alloy after the heat treatment, C concentration takes maximum at 2-20 nm depth from the surface of said alloy with equivalent $SiO_2$, the nano crystal soft magnetic alloy of the present invention shows that the alternate magnetic property is excellent with the high magnetic permeability and low magnetic core loss, $\mu_{1k}^{190}$ after maintaining 150° C. for 190 hours is high, and the changes in characteristics with time is excellent. On the other hand, the alloy which is large composition of C amount 3 atomic % (No. 35, 36) and the alloy which is not observed the C concentration segregation (No. 34) is not only the low value of alternate relative magnetic permeability $\mu_{1k}$ but also the low value of $\mu_{1k}^{190}$ after maintaining at 150° C. for 190 hours comparing to the early alternate relative magnetic permeability $\mu_{1k}$, and then the temporal stability in high temperature is inferior.

TABLE 2

| | No. | Composition (atomic %) | M | a | b | c | d | M substitute element | M substitute element ratio (%) | SI, B substitute element | SI, B substitute element ratio (%) | a + b + c + d |
|---|---|---|---|---|---|---|---|---|---|---|---|---|
| Present invention example | 1 | $Fe_{bal.}Cu_1Nb_{3.1}Si_{15.5}B_7C_{0.05}$ | Nb | 3.10 | 15.5 | 7.0 | 0.05 | | | | | 25.65 |
| | 2 | $Fe_{bal.}Cu_{0.9}Mo_{3.2}Si_{15.5}B_{7.5}C_1$ | Mo | 3.20 | 15.5 | 7.5 | 1.00 | | | | | 27.20 |
| | 3 | $Fe_{bal.}Cu_1Ta_{3.1}Si_{13.5}B_9C_{0.01}$ | Ta | 3.10 | 13.5 | 9.0 | 0.01 | | | | | 25.61 |
| | 4 | $Fe_{bal.}Cu_{1.1}W_{5.3}Si_{13.5}B_9C_{0.05}$ | W | 5.30 | 13.5 | 9.0 | 0.05 | | | | | 27.85 |
| | 5 | $Fe_{bal.}Cu_1Nb_{2.6}Ti_{0.2}Si_{13.5}B_9C_{0.05}$ | Nb, Ti | 3.00 | 13.5 | 9.0 | 0.05 | | | | | 25.55 |
| | 6 | $Fe_{bal.}Cu_1Nb_{2.6}V_{0.2}Si_{14.5}B_8C_{0.05}$ | Nb, V | 3.00 | 14.5 | 8.0 | 0.05 | | | | | 25.55 |
| | 7 | $Fe_{bal.}Cu_1Nb_{2.8}Zr_{0.2}Si_{14.5}B_8C_{0.05}$ | Nb, Zr | 3.00 | 14.5 | 8.0 | 0.05 | | | | | 25.55 |
| | 8 | $Fe_{bal.}Cu_{1.2}Nb_{2.8}Hf_{0.2}Si_{15.5}B_{7.5}C_{0.05}$ | Nb, Hf | 3.00 | 15.5 | 7.5 | 0.05 | | | | | 26.05 |
| | 9 | $Fe_{bal.}Cu_{0.6}Au_{0.2}Nb_{3.1}Si_{11.5}B_7C_{0.02}$ | Nb | 3.10 | 11.5 | 7.0 | 0.02 | | | | | 21.62 |
| | 10 | $Fe_{bal.}Cu_{0.6}Au_{0.2}Nb_{4.6}Si_{10}B_9C_{0.02}$ | Nb | 4.80 | 10.0 | 9.0 | 0.02 | | | | | 23.82 |
| | 11 | $Fe_{bal.}Cu_{0.6}Nb_{4.2}Si_9B_{10}C_{0.02}P_{0.5}$ | Nb | 4.20 | 9.2 | 10.3 | 0.02 | | | P | 2.56 | 23.72 |
| | 12 | $Fe_{bal.}Cu_{0.6}Nb_{5.8}Si_{17}B_6C_{0.02}Al_{0.5}$ | Nb | 5.80 | 17.4 | 6.1 | 0.02 | | | Al | 2.13 | 29.32 |
| | 13 | $Fe_{bal.}Co_5Cu_{0.6}Nb_{2.6}Si_{15.5}B_{7.5}C_{0.02}$ | Nb | 2.60 | 15.5 | 7.5 | 0.02 | | | | | 25.62 |
| | 14 | $Fe_{bal.}Ni_5Cu_{0.6}Nb_{2.6}Si_{15}B_8C_{0.02}$ | Nb | 2.60 | 15.0 | 8.0 | 0.02 | | | | | 25.62 |
| | 15 | $Fe_{bal.}Cu_{0.6}Nb_{2.6}Si_{14}B_9C_{0.02}Ga_{0.5}$ | Nb | 2.60 | 14.3 | 9.2 | 0.02 | | | Ga | 2.13 | 26.12 |
| | 16 | $Fe_{bal.}Cu_{0.6}Nb_{2.6}Si_{14}B_9C_{0.02}Ge_{0.5}$ | Nb | 2.60 | 14.3 | 9.2 | 0.02 | | | Ge | 2.13 | 26.12 |
| | 17 | $Fe_{bal.}Cu_{0.6}Nb_{2.6}Si_{14}B_9C_{0.02}Be_{0.1}$ | Nb | 2.60 | 14.1 | 9.0 | 0.02 | | | Be | 0.43 | 25.72 |
| | 18 | $Fe_{bal.}Cu_1Nb_{2.8}Si_{15}B_8C_{0.02}Cr_1S_{0.01}$ | Nb | 3.81 | 15.0 | 8.0 | 0.02 | S, Cr | 26.51 | | | 26.83 |
| | 19 | $Fe_{bal.}Cu_1Nb_{2.8}Si_{15}B_8C_{0.02}Mn_1O_{0.01}$ | Nb | 3.81 | 15.0 | 8.0 | 0.02 | O, Mn | 26.51 | | | 26.83 |
| | 20 | $Fe_{bal.}Cu_1Nb_{2.8}Si_{15}B_8C_{0.02}Zn_{0.05}$ | Nb | 2.85 | 15.0 | 8.0 | 0.02 | Zn | 1.75 | | | 25.87 |
| | 21 | $Fe_{bal.}Cu_1Nb_{2.8}Si_{15}B_8C_{0.02}Se_{0.01}$ | Nb | 2.81 | 15.0 | 8.0 | 0.02 | Se | 0.36 | | | 25.83 |
| | 22 | $Fe_{bal.}Cu_1Nb_{2.8}Si_{15}B_8C_{0.02}Sb_{0.01}$ | Nb | 2.81 | 15.0 | 8.0 | 0.02 | Sb | 0.36 | | | 25.83 |
| | 23 | $Fe_{bal.}Cu_1Nb_{2.8}Si_{15}B_8C_{0.02}Sn_{0.1}$ | Nb | 2.90 | 15.0 | 7.0 | 0.02 | Sn | 3.45 | | | 24.92 |
| | 24 | $Fe_{bal.}Cu_1Nb_{2.8}Si_{15}B_8C_{0.02}In_{0.1}$ | Nb | 2.90 | 15.0 | 7.5 | 0.02 | In | 3.45 | | | 25.42 |
| | 25 | $Fe_{bal.}Cu_1Nb_{2.8}Si_{15}B_8C_{0.02}Cd_{0.01}$ | Nb | 2.81 | 15.0 | 8.0 | 0.02 | Cd | 0.36 | | | 25.83 |
| | 26 | $Fe_{bal.}Cu_1Nb_{2.8}Si_{15}B_8C_{0.02}Ag_{0.01}$ | Nb | 2.81 | 15.0 | 8.0 | 0.02 | Ag | 0.36 | | | 25.83 |
| | 27 | $Fe_{bal.}Cu_1Nb_{2.8}Si_{15}B_8C_{0.02}Bi_{0.1}Y_{0.02}$ | Nb | 3.12 | 15.0 | 8.0 | 0.02 | Bi, Y | 3.85 | | | 26.14 |
| | 28 | $Fe_{bal.}Cu_1Nb_{2.8}Si_{15}B_8C_{0.02}Mg_{0.1}$ | Nb | 2.90 | 15.0 | 8.0 | 0.02 | Mg | 3.45 | | | 25.92 |
| | 29 | $Fe_{bal.}Cu_1Nb_{2.8}Si_{15}B_8C_{0.02}Sc_{0.1}$ | Nb | 2.90 | 15.0 | 8.0 | 0.02 | Sc | 3.45 | | | 25.92 |
| | 30 | $Fe_{bal.}Cu_1Mo_{3.5}Si_{15}B_8C_{1.5}Re_{0.1}Pd_{0.1}$ | Mo | 3.70 | 15.0 | 8.0 | 1.50 | Pd, Re | 5.41 | | | 28.20 |

TABLE 2-continued

| | | | | | | | | | | | |
|---|---|---|---|---|---|---|---|---|---|---|---|
| | 31 | $Fe_{bal.}Cu_1Nb_{2.6}Si_{15}B_8C_{0.02}Pt_{0.1}$ | Nb | 2.90 | 15.0 | 8.0 | 0.02 | Pt | 3.45 | | 25.92 |
| | 32 | $Fe_{bal.}Cu_{0.5}Nb_{7.2}B_9C_{0.05}Dy_{0.01}$ | Nb | 7.21 | 0.0 | 9.0 | 0.05 | Dy | 0.14 | | 16.26 |
| | 33 | $Fe_{bal.}Cu_{0.5}Nb_{2.6}Si_8B_{12}C_{0.02}$ | Nb | 2.60 | 8.0 | 12.0 | 0.02 | | | | 22.62 |
| Comparative | 34 | $Fe_{bal.}Cu_{0.5}Nb_3Si_{16}B_8C_{0.005}$ | Nb | 3.00 | 16.0 | 6.0 | 0.01 | | | | 25.01 |
| example | 35 | $Fe_{bal.}Cu_{0.7}Mo_3Si_{16}B_7C_3$ | Mo | 3.00 | 16.0 | 7.0 | 3.00 | | | | 29.00 |
| | 36 | $Fe_{bal.}Cu_{0.5}Nb_7Si_1B_9C_3$ | Nb | 7.00 | 1.0 | 9.0 | 3.00 | | | | 20.00 |

| | No. | Fe substitute element (1) | Fe substitute element (1) ratio (%) | Fe substitute element (2) | Fe substitute element (2) ratio (%) | Alternate relative magnetic permeability $\mu_{1k}$ [1 kHz] | Magnetic core loss $P_{cv}$ (kW $m^{-3}$) | $\mu_{1k}^{190}$ | Average crystal grain diameter D (nm) | C concentration maximum position (nm) before heat treatment | After heat treatment |
|---|---|---|---|---|---|---|---|---|---|---|---|
| Present | 1 | Cu | 1.34 | | | 100200 | 280 | 100100 | 12 | 6.4 | 6.4 |
| invention | 2 | Cu | 1.24 | | | 89100 | 310 | 88800 | 15 | 5.7 | 5.8 |
| example | 3 | Cu | 1.34 | | | 85600 | 290 | 84800 | 11 | 5.8 | 5.9 |
| | 4 | Cu | 1.52 | | | 82200 | 310 | 82000 | 14 | 6.2 | 6.1 |
| | 5 | Cu | 1.34 | | | 84600 | 280 | 84100 | 12 | 5.5 | 5.5 |
| | 6 | Cu | 1.34 | | | 91200 | 270 | 90800 | 13 | 6.3 | 6.4 |
| | 7 | Cu | 1.34 | | | 95600 | 280 | 94800 | 11 | 6.4 | 6.4 |
| | 8 | Cu | 1.62 | | | 94300 | 290 | 94100 | 11 | 5.8 | 5.9 |
| | 9 | Cu, Au | 1.02 | | | 88100 | 300 | 87900 | 12 | 6 | 6 |
| | 10 | Cu, Au | 1.05 | | | 82200 | 310 | 81900 | 14 | 6.4 | 6.4 |
| | 11 | Cu | 0.79 | | | 82100 | 310 | 81600 | 14 | 5.9 | 5.9 |
| | 12 | Cu | 0.85 | | | 83800 | 310 | 83100 | 15 | 5.5 | 5.6 |
| | 13 | Cu | 0.81 | Co | 6.72 | 83800 | 270 | 83200 | 14 | 5.5 | 5.5 |
| | 14 | Cu | 0.81 | Ni | 6.72 | 82500 | 270 | 82000 | 14 | 5.6 | 5.6 |
| | 15 | Cu | 0.81 | | | 102500 | 260 | 101000 | 12 | 5.5 | 5.5 |
| | 16 | Cu | 0.81 | | | 104300 | 260 | 102000 | 12 | 6.4 | 6.4 |
| | 17 | Cu | 0.81 | | | 96800 | 280 | 96200 | 12 | 5.9 | 5.9 |
| | 18 | Cu | 1.37 | | | 94900 | 270 | 94400 | 13 | 6.1 | 6.1 |
| | 19 | Cu | 1.37 | | | 83600 | 280 | 83400 | 13 | 6 | 5.9 |
| | 20 | Cu | 1.35 | | | 84600 | 290 | 84000 | 13 | 5.9 | 5.9 |
| | 21 | Cu | 1.35 | | | 85500 | 280 | 85100 | 13 | 5.6 | 5.6 |
| | 22 | Cu | 1.35 | | | 83300 | 290 | 83000 | 13 | 5.6 | 5.5 |
| | 23 | Cu | 1.33 | | | 87900 | 300 | 87400 | 14 | 6.5 | 6.5 |
| | 24 | Cu | 1.34 | | | 90600 | 300 | 89800 | 13 | 6.4 | 6.4 |
| | 25 | Cu | 1.35 | | | 84600 | 300 | 84400 | 13 | 5.8 | 5.8 |
| | 26 | Cu | 1.35 | | | 86600 | 300 | 86400 | 13 | 5.6 | 5.7 |
| | 27 | Cu | 1.35 | | | 83900 | 300 | 83800 | 12 | 5.6 | 5.6 |
| | 28 | Cu | 1.35 | | | 84700 | 290 | 84600 | 13 | 5.5 | 5.5 |
| | 29 | Cu | 1.35 | | | 85600 | 280 | 85400 | 13 | 6.6 | 6.6 |
| | 30 | Cu | 1.39 | | | 83100 | 310 | 83000 | 15 | 5.7 | 5.8 |
| | 31 | Cu | 1.35 | | | 89100 | 300 | 88900 | 13 | 5.9 | 5.8 |
| | 32 | Cu | 0.60 | | | 81400 | 320 | 81200 | 11 | 7 | 7 |
| | 33 | Cu | 0.78 | | | 82500 | 310 | 82400 | 12 | 5.8 | 5.8 |
| Comparative | 34 | Cu | 0.67 | | | 79200 | 340 | 67500 | 13 | — | — |
| example | 35 | Cu | 0.99 | | | 78100 | 350 | 66900 | 14 | 5.6 | 5.6 |
| | 36 | Cu | 0.63 | | | 43000 | 340 | 35600 | 11 | 7.2 | 7.2 |

INDUSTRIAL APPLICABILITY

In the present invention, the effect is prominent even if produced from a broad amorphous alloy ribbon which is used cheap materials since a nano crystal soft magnetic alloy, a magnetic core made of a nano crystal soft magnetic alloy, and the amorphous alloy ribbon for a nano crystal soft magnetic alloys which has the excellent alternate magnetic property, the small dispersion, the excellent temporal stability in high temperature, the excellent mass productivity can be provided.

BRIEF DESCRIPTION OF THE DRAWINGS

[Drawing 1]

It is a drawing showing an example of the measured result by the surface depth direction element concentration analysis from the roll face (surface in contact with a roll) of the amorphous alloy ribbon of the embodiment of the present invention was conducted in GD-OES (glow discharge luminescence surface analysis apparatus).

[Drawing 2]

Figure 1:
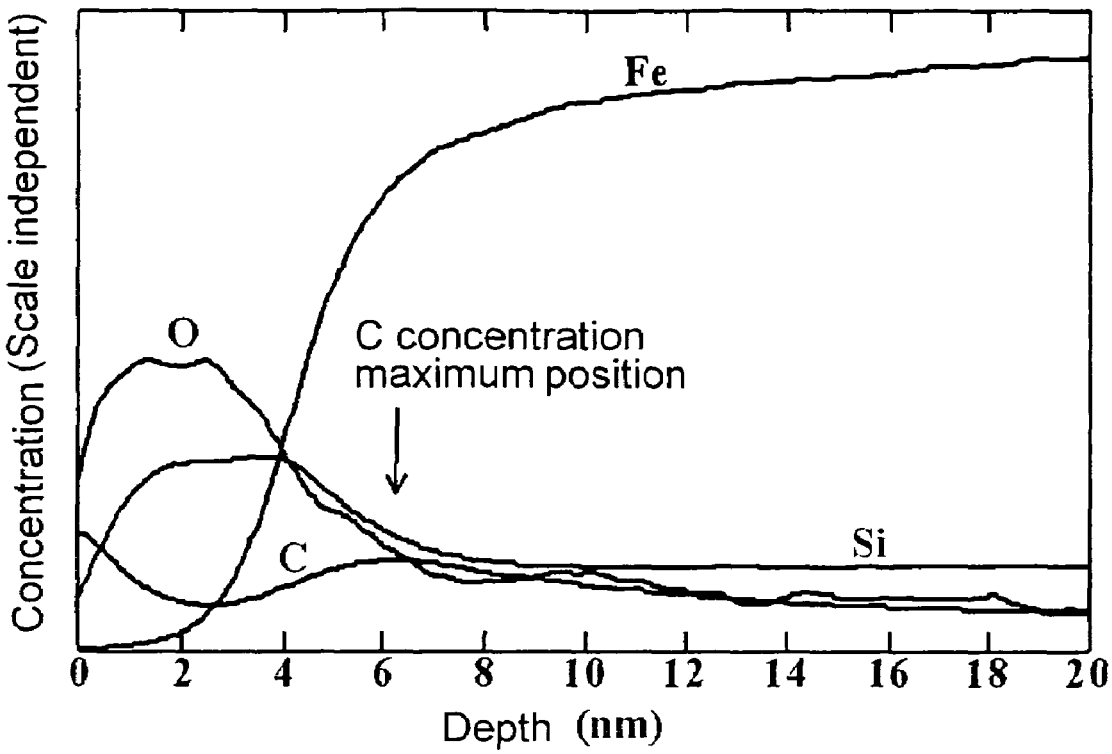
Figure 2:
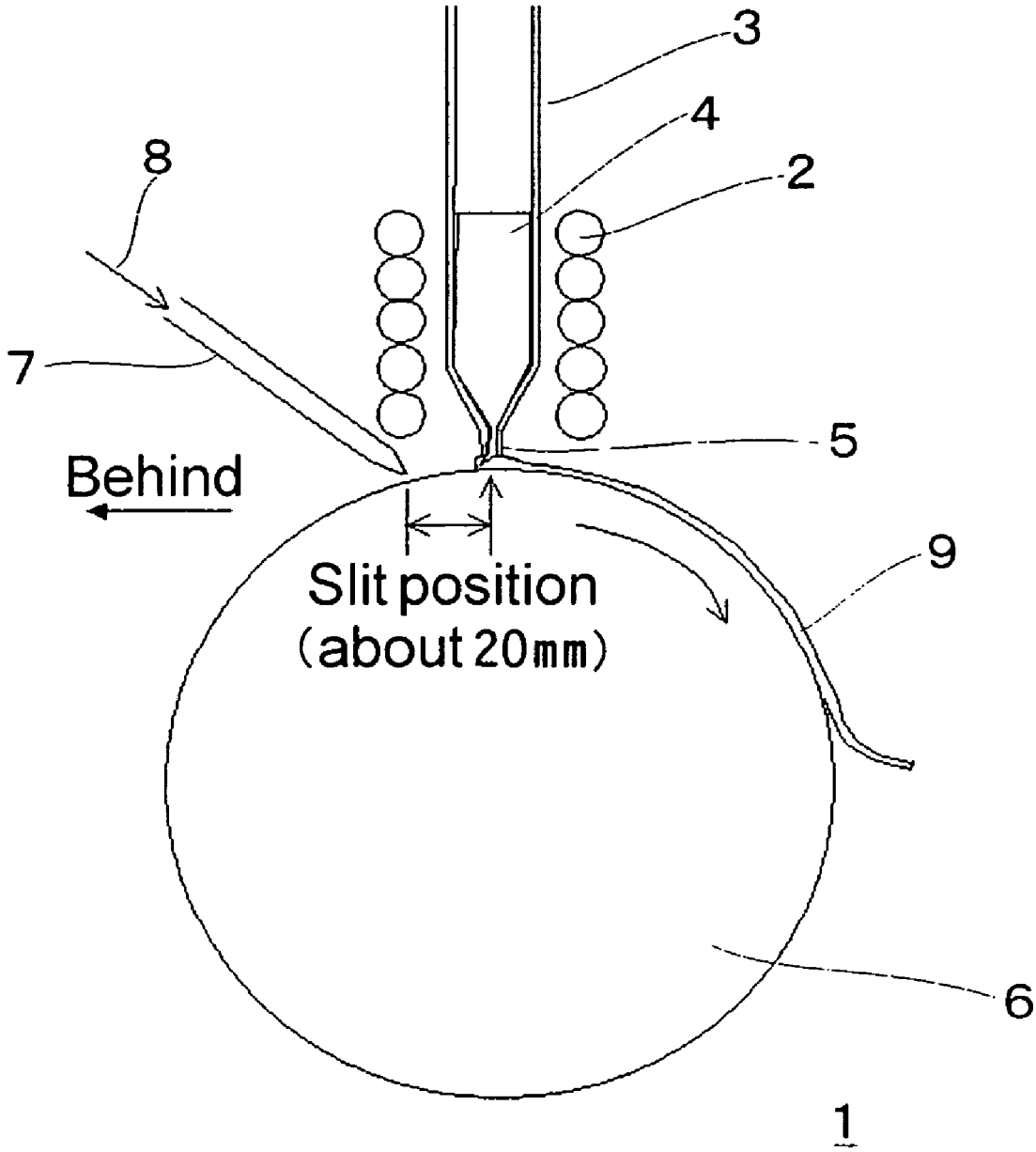

It is a pattern diagram around the nozzle of the amorphous alloy ribbon production apparatus concerning the production of the embodiment of the present invention.

What is claimed is:

1. An amorphous alloy ribbon, wherein the alloy composition is represented by $Fe_{100-a-b-c-d}M_aSi_bB_cC_d$ (atomic %), $0<a\leqq 10$, $8\leqq b\leqq 17$, $5\leqq c\leqq 10$, $0.01<d\leqq 0.05$, $9\leqq a+b+c+d\leqq 35$, wherein greater than or equal to 0.5 atomic % and less than or equal to 2 atomic % of Fe is substituted by at least one element selected from Cu and Au, and an amorphous alloy ribbon consists of inevitable impurities, said M is at least one element selected from Ti, V, Zr, Nb, Mo, Hf, Ta, and W, and C concentration takes a maximum value, by glow discharge luminescence surface analysis, at a 2-20 nm $SiO_2$ equivalent depth from the surface of said amorphous alloy ribbon.

2. The amorphous alloy ribbon according to claim 1, wherein a part of Fe is substituted by at least one element selected from Co and Ni.

3. The amorphous alloy ribbon according to claim 1, wherein greater than or equal to 0.43% and less than or equal to 50% of total amount of Si and B is substituted by at least one element selected from Al, P, Ga, Ge, and Be.

4. The amorphous alloy ribbon according to claim 2, wherein greater than or equal to 0.43% and less than or equal to 50% of total amount of Si and B is substituted by at least one element selected from Al, P, Ga, Ge, and Be.

5. The amorphous alloy ribbon according to claim 1, wherein greater than or equal to 0.14% and less than or equal to 50% of M is substituted by at least one element selected from Cr, Mn, Zn, As, Se, S, O, N, Sb, Sn, In, Cd, Ag, Bi, Mg, Sc, Re, platinoid elements, Y, and rare earth elements.

6. The amorphous alloy ribbon according to claim 2, wherein greater than or equal to 0.14% and less than or equal to 50% of M is substituted by at least one element selected from Cr, Mn, Zn, As, Se, S, O, N, Sb, Sn, In, Cd, Ag, Bi, Mg, Sc, Re, platinoid elements, Y, and rare earth elements.

7. The amorphous alloy ribbon according to claim 3, wherein greater than or equal to 0.14% and less than or equal to 50% of M is substituted by at least one element selected from Cr, Mn, Zn, As, Se, S, O, N, Sb, Sn, In, Cd, Ag, Bi, Mg, Sc, Re, platinoid elements, Y, and rare earth elements.

8. The amorphous alloy ribbon according to claim 4, wherein greater than or equal to 0.14% and less than or equal to 50% of M is substituted by at least one element selected from Cr, Mn, Zn, As, Se, S, O, N, Sb, Sn, In, Cd, Ag, Bi, Mg, Sc, Re, platinoid elements, Y, and rare earth elements.

9. The amorphous alloy ribbon according to claim 1 fabricated by a single roll method, wherein an atmosphere around a roll surface of a nozzle tip part includes an elevated concentration of $CO_2$.

10. The amorphous alloy ribbon according to claim 1 fabricated by a single roll method, comprising setting up equipment for the single roll method in a chamber and introducing $CO_2$ gas into the chamber, so that C concentration in said amorphous alloy ribbon takes said maximum value at said $SiO_2$ equivalent depth.

11. A nanocrystalline soft magnetic alloy which is formed by heat treatment of the amorphous alloy ribbon according to claim 1, wherein at least a part of a structure of the nanocrystalline soft magnetic alloy consists of a crystal grain with a mean particle size of less than or equal to 50 nm and C concentration in said soft magnetic alloy takes said maximum value at said $SiO_2$ equivalent depth.

12. A magnetic core comprising the nanocrystalline soft magnetic alloy according to claim 11.

* * * * *